US007321740B2

(12) United States Patent
Choi et al.

(10) Patent No.: US 7,321,740 B2
(45) Date of Patent: Jan. 22, 2008

(54) DEVELOPING CARTRIDGE AND ELECTROPHOTOGRAPHIC IMAGE FORMING APPARATUS EMPLOYING THE SAME

(75) Inventors: Sam-Seok Choi, Suwon-si (KR); Dong-Hoon Park, Osan-si (KR)

(73) Assignee: Samsung Electronics Co., Suwon-si, Gyeonggi-do (KR)

( * ) Notice: Subject to any disclaimer, the term of this patent is extended or adjusted under 35 U.S.C. 154(b) by 158 days.

(21) Appl. No.: 11/242,080

(22) Filed: Oct. 4, 2005

(65) Prior Publication Data

US 2006/0159487 A1 Jul. 20, 2006

(30) Foreign Application Priority Data

Jan. 20, 2005 (KR) ..... 10-2005-0005401

(51) Int. Cl.
*G03G 21/18* (2006.01)

(52) U.S. Cl. ..... 399/113

(58) Field of Classification Search ..... 399/113, 399/111

See application file for complete search history.

(56) References Cited

U.S. PATENT DOCUMENTS

2002/0071693 A1* 6/2002 Shimaoka ..... 399/113
2002/0122674 A1* 9/2002 Yokoi et al. ..... 399/113
2003/0185587 A1* 10/2003 Kawai et al. ..... 399/111

FOREIGN PATENT DOCUMENTS

| | | | |
|---|---|---|---|
| JP | 03-264967 | | 11/1991 |
| JP | 05-323693 | A * | 12/1993 |
| JP | 08-211739 | | 8/1996 |
| JP | 09-152826 | A * | 6/1997 |
| JP | 11-038722 | | 2/1999 |
| KR | 2004-000640 | | 1/2004 |
| KR | 2004-003376 | | 1/2004 |

* cited by examiner

*Primary Examiner*—Sophia S. Chen
(74) *Attorney, Agent, or Firm*—Roylance, Abrams, Berdo & Goodman, LLP

(57) ABSTRACT

A developing cartridge is provided including a first frame on which a photosensitive drum is arranged, a second frame which is pivotably coupled to the first frame, and a developing roller which is coupled to the second frame. A pair of gap maintaining elements configured to facilitate maintenance of a constant developing gap are arranged on both ends of the developing roller. The developing roller and the pair of gap maintaining elements are arranged on the second frame to pivot in a direction opposite to a pivoting direction of the second frame.

16 Claims, 5 Drawing Sheets

DEVELOPING CARTRIDGE AND ELECTROPHOTOGRAPHIC IMAGE FORMING APPARATUS EMPLOYING THE SAME

CROSS-REFERENCE TO RELATED APPLICATIONS

This application claims the benefit under 35 U.S.C. 119(a) of Korean Patent Application No. 10-2005-0005401, filed on Jan. 20, 2005, the entire disclosure of which is hereby incorporated by reference.

BACKGROUND OF THE INVENTION

1. Field of the Invention

The present invention relates to a developing cartridge and an electrophotographic image forming apparatus employing the same. More particularly, the present invention relates to a developing cartridge which includes a photosensitive drum and a developing roller, and an electrophotographic image forming apparatus employing the developing cartridge.

2. Description of the Related Art

An electrophotographic image forming apparatus emits light onto a photosensitive medium that is electrostatically charged with a uniform potential and forms an electrostatic latent image corresponding to a desired image. Then, the electrophotographic image forming apparatus supplies toner to the electrostatic latent image to develop the image, transfers the image onto an intermediate transfer medium or directly onto a print medium, and then applies heat and pressure to the transferred image to fix the image thereon to print the image.

An electrophotographic image forming apparatus includes a developing cartridge. The developing cartridge includes a photosensitive drum and a developing roller. In a non-contact developing method employing a developing cartridge, the developing roller is spaced from the photosensitive drum to form a developing gap. The developing gap is a very important factor to take into consideration for printing good quality images and producing high developing efficiency. The developing gap preferably is maintained constant during the printing operation. The photosensitive drum and the developing roller rotate via connection to power transmitting elements such as a motor, a gear, or a belt. Vibrations produced while the photosensitive drum and the developing roller rotate, change the developing gap. Thus, vibrations may deteriorate the quality of a printed image.

Accordingly, there is a need for a developing cartridge which can maintain a constant developing gap and reduce vibrations.

SUMMARY OF THE INVENTION

Embodiments of the present invention address at least the above problems and/or disadvantages and provide at least the advantages described below. Accordingly, an aspect of the present invention is to provide a developing cartridge, which prevents changes in a developing gap caused by vibration, and an electrophotographic image forming apparatus employing the same.

According to an exemplary embodiment of the present invention, there is provided a developing cartridge including a first frame in which a photosensitive drum is arranged and a second frame in which a developing roller is arranged and coupled to the first frame so that the second frame is elastically pivotable in a direction in which the developing roller approaches or separates from the photosensitive drum. A pair of gap maintaining elements limit the pivoting of the second frame in a direction in which the developing roller approaches the photosensitive drum by being rotatably coupled to both ends of the developing roller and being in contact with the photosensitive drum so that the developing roller can be arranged at a location that maintains a developing gap with the photosensitive drum. The developing roller and the pair of gap maintaining elements are arranged on the second frame to elastically pivot in an opposite direction to a pivoting direction of the second frame.

According to one embodiment of the invention, the pivot point of the developing roller and the pair of gap maintaining elements with respect to the second frame and pivot point of the second frame with respect to the first frame may be the same.

According to another exemplary embodiment, there is provided an electrophotographic image forming apparatus including a photosensitive drum on which an electrostatic latent image is formed. At least one developing cartridge has a developing roller that develops a toner image by supplying a developer to the electrostatic latent image transfer uni, transfers the toner images onto a medium. The developing cartridge has a first frame in which the photosensitive drum is arranged and a second frame which is pivotably coupled to the first frame. The developing roller is coupled to the second frame. A first elastic element provides an elastic force to the second frame so that the second frame can pivot in the direction in which the developing roller approaches the photosensitive drum. Gap maintaining elements limit the pivoting of the second frame in a direction in which the developing roller approaches the photosensitive drum so that the developing roller can be arranged at a location that maintains a developing gap with the photosensitive drum. The developing roller and the gap maintaining elements are arranged on the second frame to elastically move in an opposite direction to a pivoting direction of the second frame.

According to another embodiment, there is provided a developing cartridge including a first frame arranged on a photosensitive drum. A second frame is provided in which a developing roller is arranged and coupled to the first frame. A pair of gap maintaining elements are rotatably coupled to both ends of the developing roller and contact the photosensitive drum so that the developing roller can be arranged at a location to maintain a developing gap with the photosensitive drum. The developing roller and the pair of gap maintaining elements are arranged on the second frame to be elastically pivotable in a direction in which the gap maintaining elements contact the photosensitive drum.

According to still yet another exemplary embodiment of the present invention, there is provided an electrophotographic image forming apparatus including a photosensitive drum on which an electrostatic latent image is formed. A developing cartridge having a developing roller that develops a toner image by supplying a developer to the electrostatic latent image and a transfer unit which transfers the toner images onto a print paper are provided. The developing cartridge has a first frame in which the photosensitive drum is arranged, a second frame in which the developing roller is arranged and is coupled to the first frame, and a pair of gap maintaining elements rotatably coupled to both ends of the developing roller and contacting the photosensitive drum so that the developing roller can be arranged at a location to maintain a developing gap with the photosensitive drum. The developing roller and the pair of gap maintaining elements are arranged on the second frame to elastically pivot in a direction in which the gap maintaining elements contact the photosensitive drum.

The electrophotographic image forming apparatus may further include a plurality of developing cartridges, in which developers of different colors are stored, in the second frame and a plurality of exposure elements which emit light onto the photosensitive drum of each of the plurality of developing cartridges. The transfer unit includes a paper transporting belt which is arranged to face the photosensitive drums of the plurality of developing cartridges and supports and transports the print paper. A plurality of transfer rollers which are arranged to face the photosensitive drums with the paper transporting belt therebetween, and on which transfer bias is applied to transfer the toner image formed on outer circumferences of the photosensitive drums to the medium are also provided.

In another embodiment the light emitted from the plurality of exposure elements may be emitted onto each of the photosensitive drums through spaces formed between the first and second frames in the plurality of developing cartridges.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
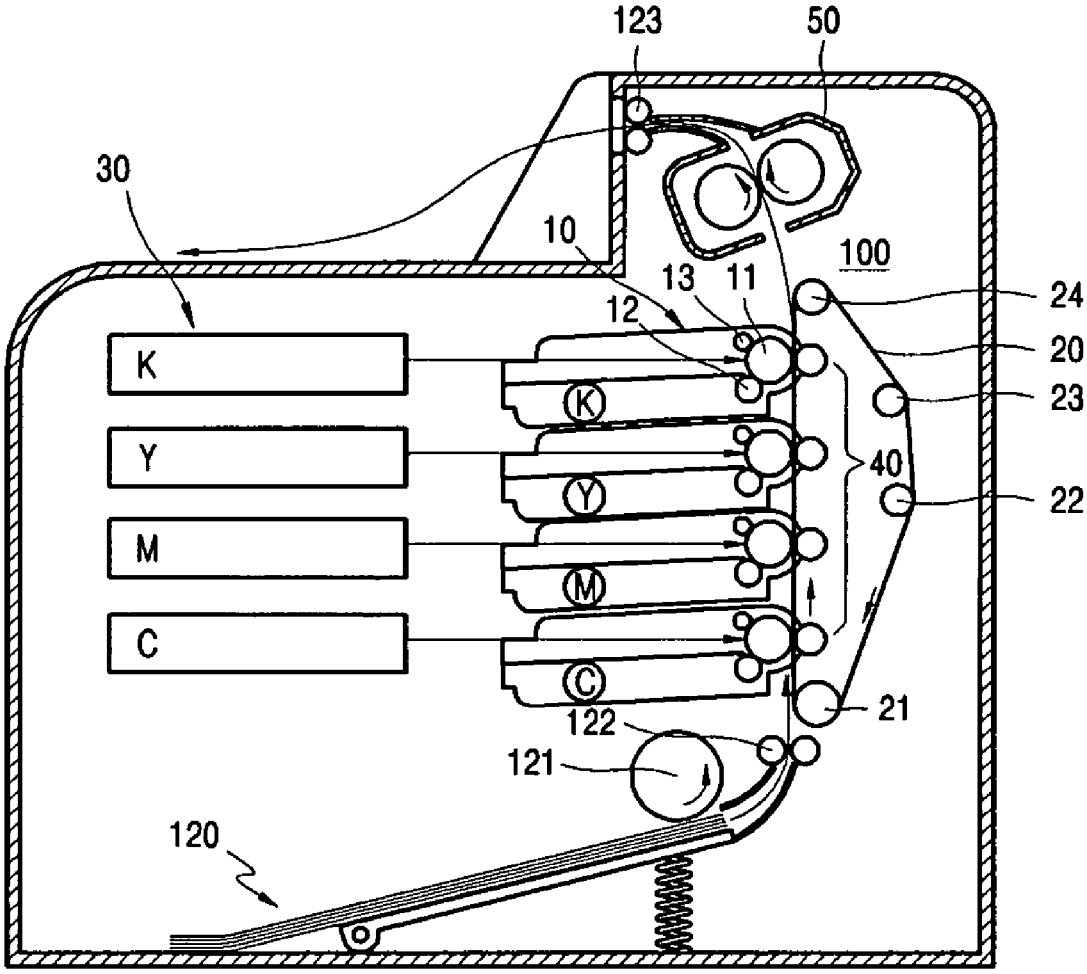
FIG. 1 is a structural diagram of an electrophotographic image forming apparatus in accordance with an embodiment of the present invention.

FIG. 1 is a structural diagram of an electrophotographic image forming apparatus according to an exemplary embodiment of the present invention. In the present exemplary embodiment, the image forming apparatus is a color electrophotographic image forming apparatus.

Referring to FIG. 1, the electrophotographic image forming apparatus includes a printing unit 100, which prints an image on a print paper through an electrophotographic process, a cassette 120, in which print papers are stacked, a pickup roller 121, which picks up the print paper from the cassette 120, and a transport roller 122, which transports the print paper. The electrophotographic image forming apparatus in the present exemplary embodiment is a dry process electrophotographic image forming apparatus that uses a dry developer such as toner.

The printing unit 100 includes an exposure unit 30, a developing cartridge 10, a transfer unit, and a fixer 50. In the present exemplary embodiment, the printing unit 100 includes different color toners to print a color image. For example, the printing unit 100 includes four developing cartridges 10C, 10M, 10Y, and 10K in which cyan (C), magenta (M), yellow (Y), and black (K) color toners are respectively accommodated therein. The printing unit 100 also includes four exposure elements 30C, 30M, 30Y, and 30K which correspond to each of the developing cartridges 10C, 10M, 10Y, and 10K.

Figure 2:
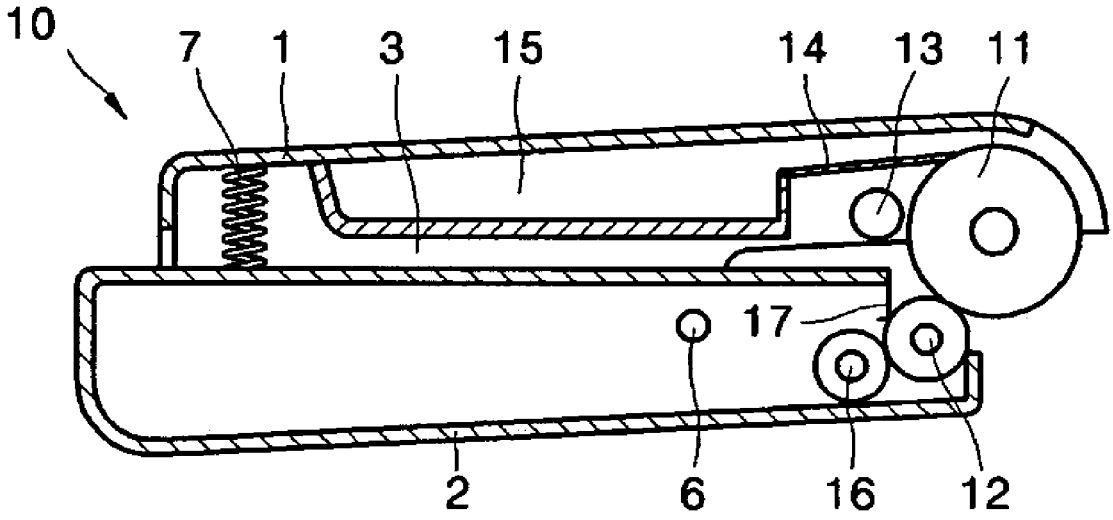
FIG. 2 is a cross-sectional view of a developing cartridge for the electrophotographic image forming apparatus of FIG. 1.

Referring to FIG. 2, each of the developing cartridges 10C, 10M, 10Y, and 10K include a photosensitive drum 11 and a developing roller 12. Each of the developing cartridges 10C, 10M, 10Y, and 10K include a first frame 1 and a second frame 2. The photosensitive drum 11 is arranged on the first frame 1, and the developing roller 12 is arranged on the second frame 2. The toner is accommodated in the second frame 2. The second frame 2 is pivotally coupled to the first frame 1. The second frame 2 is coupled to the first frame via through-holes 4 and 5 formed on both sides of the first and second frames 1 and 2, respectively (see FIG. 3). A pair of coupling pins 6 are inserted into the through-holes 4 and 5. The coupling pins 6 couple the first and second frames 1 and 2. The pair of coupling pins 6 are the pivot point of the second frame 2.

A first spring such as a elastic element 7 provides an elastic force to the second frame 2. Thus, the second frame 2 is biased in a direction towards the first frame 1 and the photosensitive drum 11. A pair of gap rings 18 (see FIG. 3) are arranged on both ends of the developing roller 12. The pair of gap rings 18 are an example of a gap maintaining elements. The pair of gap rings contact the photosensitive drum 11 to limit pivoting of the developing roller 12. Consequently, pivoting of the second frame 2 is limited.

When the first and second frames 1 and 2 are coupled, a space 3 is formed between the first and second frames 1 and 2. Light emitted by the exposure elements 30C, 30M, 30Y, and 30K is irradiated on the photosensitive drum 11 through the space 3.

Each of the developing cartridges 10C, 10M, 10Y, and 10K further include an electrostatic charging roller 13. A charge bias is applied to the electrostatic charging roller 13 to charge the outer circumference of the photosensitive drum 11 with a uniform potential. The electrostatic roller 13 is arranged on either the first frame 1 or the second frame 2. A corona discharger (not shown) may be employed instead of the electrostatic charging roller 13. A cleaning blade 14 removes toner on the outer circumference of the photosensitive drum 11 before charging. The toner removed from the photosensitive drum 11 is stored in an accommodating unit 15. The developing roller 12 adheres toner on a outer circumference and supplies the toner to the photosensitive drum 11. A developing bias is applied to the developing roller 12 to supply the toner to the photosensitive drum 11.

A supplying roller 16, which adheres the toner to the developing roller 12, a limiting element 17, which limits the amount of toner adhered to the developing roller 12, an agitator (not shown) which transports the toner accommodated inside the second frame 2 to the supplying roller 16 and a developing roller 12 may be further arranged on the second frame 2.

The transfer unit includes a paper transporting belt 20 and four transfer rollers 40. The paper transporting belt 20 faces the outer circumference of each of the photosensitive drums 11 that are exposed to the outside of the developing cartridges 10C, 10M, 10Y, and 10K. The paper transporting belt 20 revolves, while being supported by a plurality of supporting rollers 21, 22, 23, and 24. In the present exemplary embodiment, the paper transporting belt 20 is arranged vertically. The four transfer rollers 40 are disposed to face each of the photosensitive drums 11 of the developing cartridges 10C, 10M, 10Y, and 10K with the paper transporting belt 20 arranged therebetween. A transfer bias is applied to the transfer rollers 40. Each of the exposure elements 30C, 30M, 30Y, and 30K respectively emit light of cyan, magenta, yellow, and black colors, corresponding to information on an image, to each of the photosensitive drums 11 of the developing cartridges 10C, 10M, 10Y, and 10K. In the present exemplary embodiment, a laser scanning unit (LSU), which uses a laser diode as its light source, is used as the exposure elements 30C, 30M, 30Y, and 30K.

The color image forming process performed by the electrophotographic image forming apparatus having the above described structure will now be described.

Each of the photosensitive drums 11 of the developing cartridges 10C, 10M, 10Y, and 10K are uniformly electrostatically charged by an electrostatic bias applied to each of the electrostatic rollers 13. The four exposure units 30C, 30M, 30Y, and 30K respectively emit light of cyan, magenta, yellow, and black colors onto each of the photosensitive drums 11 of the developing cartridges 10C, 10M, 10Y, and 10K, through the space 3 to form electrostatic latent images. Developing bias is applied to each of the developing rollers 12. Then, toner adhered to the outer circumference of the developing roller 12 forms cyan, magenta, yellow, and black color toner images on each of the photosensitive drums 11 of the developing cartridges 10C, 10M, 10Y, and 10K, respectively.

Paper is picked up from the cassette 120 by the pickup roller 121. The print paper is led onto the paper transporting belt 20 by the transport roller 122. The print paper sticks to a surface of the paper transporting belt 20, due to the electrostatic charge, and is transported at about the same speed as the revolving speed of the paper transporting belt 20.

For example, a top end of a print paper reaches a transfer nip, which faces the transfer roller 40, about the time a top end of a cyan color toner image formed on the outer circumference of the photosensitive drum 11 of the developing cartridge 10C reaches the transfer nip. The cyan color toner image formed on the outer circumference of the photosensitive drum 11 is transferred onto the print paper when the transfer bias is applied to the transfer roller 40. As the print paper is transported, a magenta color toner image, a yellow color toner image, and a black color toner image formed on each of the photosensitive drums 11 of the developing cartridges 10M, 10Y, and 10K are sequentially transferred and superimposed onto the print paper. Thus, a color toner image is formed on the print paper. The fixer 50 applies heat and pressure onto the color toner image formed on the print paper to fix the color toner image thereon. When fixing the color toner image onto the print paper is finished, the print paper is discharged to the outside of the electrophotographic image forming apparatus by a discharge roller 123. Thus, the structure of the electrophotographic image forming apparatus can be simplified by directly transferring the color toner image of the photosensitive drum 11 onto the print paper without having to go through an intermediate transfer process.

While the printing operation is being performed, the photosensitive drum 11 and the developing roller 12 rotate via connection to power transmitting elements such as a motor (not shown), a gear, and a belt. The second frame 2 and the developing roller 12 pivot with respect to the pair of coupling pins 6, via the vibration produced, while the photosensitive drum 11 and the developing roller 12 rotate. As a result, the developing roller 12 may also move away from the photosensitive drum 11. The developing roller returns toward the photosensitive drum 11 due to the elastic force of the first spring 7. Here, the developing gap changes, and thus the amount of toner used to form an electrostatic image of the photosensitive drum 11 from the developing roller 12 is relatively uneven. Therefore, the image density can be irregular. Moreover, the pair of gap rings 18 repeatedly impact the photosensitive drum 111 through contact with and separation from the photosensitive drum 11. Thus, the photosensitive drum 11 can be damaged.

To prevent the developing gap from changing due to the vibration produced, as described above, the developing cartridge and the electrophotographic image forming apparatus employing the same arranges the developing roller 12 and gap maintaining elements in a way so that they are elastically movable in a direction opposite to the pivoting direction of the second frame 2.

Figure 3:
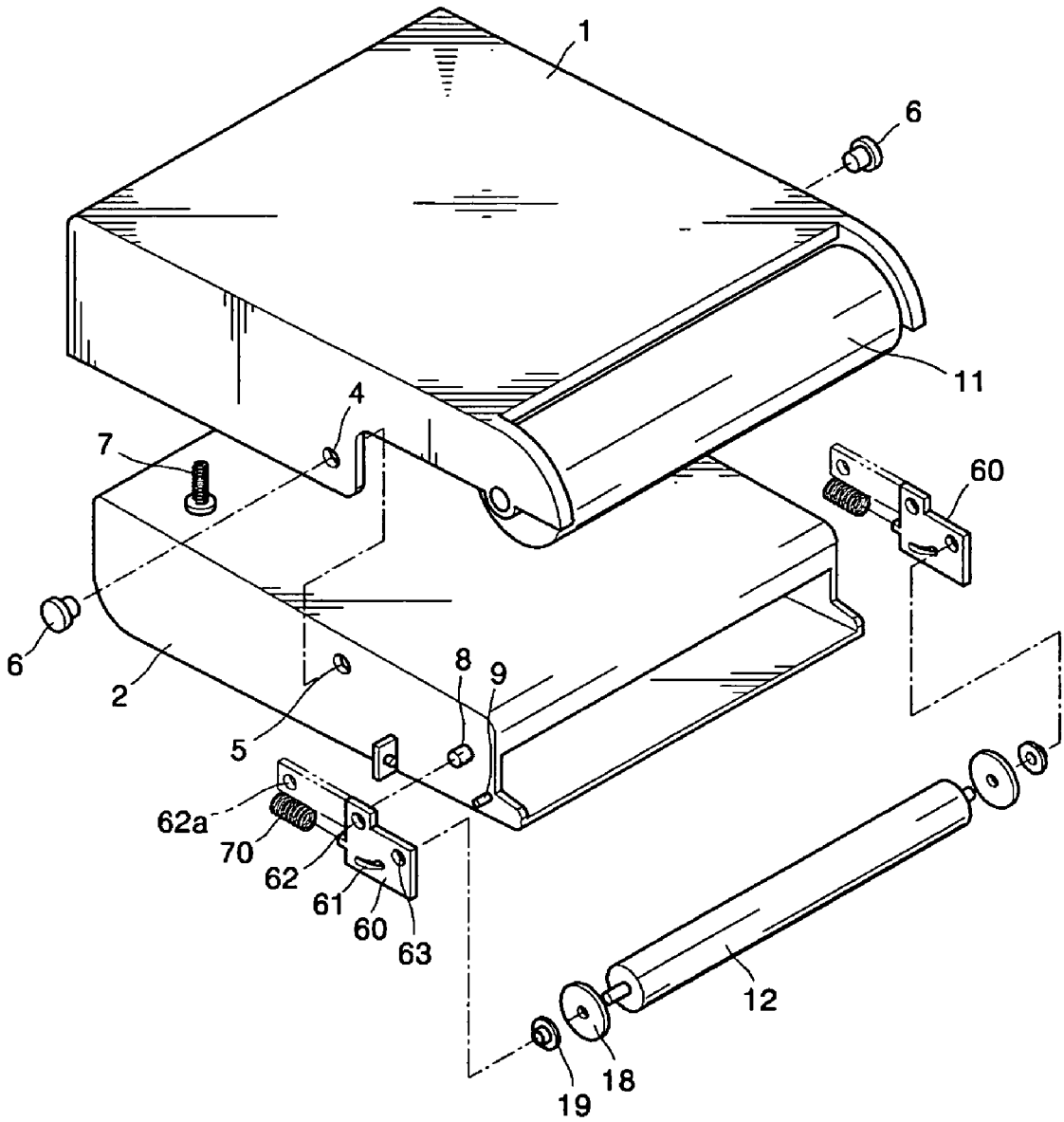
FIG. 3 is an exploded perspective view of the developing cartridge illustrated in FIG. 2.

In the exemplary embodiment, the second frame 2 is arranged so that it can elastically pivot towards the first frame 1 about coupling pins 6. Referring to FIG. 3, a pair of pivot pins 8 are formed on both sides of the second frame 2. Through-holes 62, though which the pivot pins 8 are inserted, are formed on a pair of brackets 60. Accordingly, the brackets 60 are coupled to the second frame 2 so that they can pivot about the pivot pins 8. Stoppers 9 are inserted into slots 61 formed on the brackets 60 to guide the pivoting of the brackets 60 as well as to prevent excessive pivoting of the brackets 60. Bushes 19 are inserted into both ends of the developing roller 12, and are inserted into through-holes 63 formed on the brackets 60. The developing roller 12 is rotatably supported by the brackets 60. Second springs such as elastic elements 70 push the brackets 60 so that the developing roller 12 and the gap rings 18 pivot towards the and away from the photosensitive drum 11.

Figure 4:
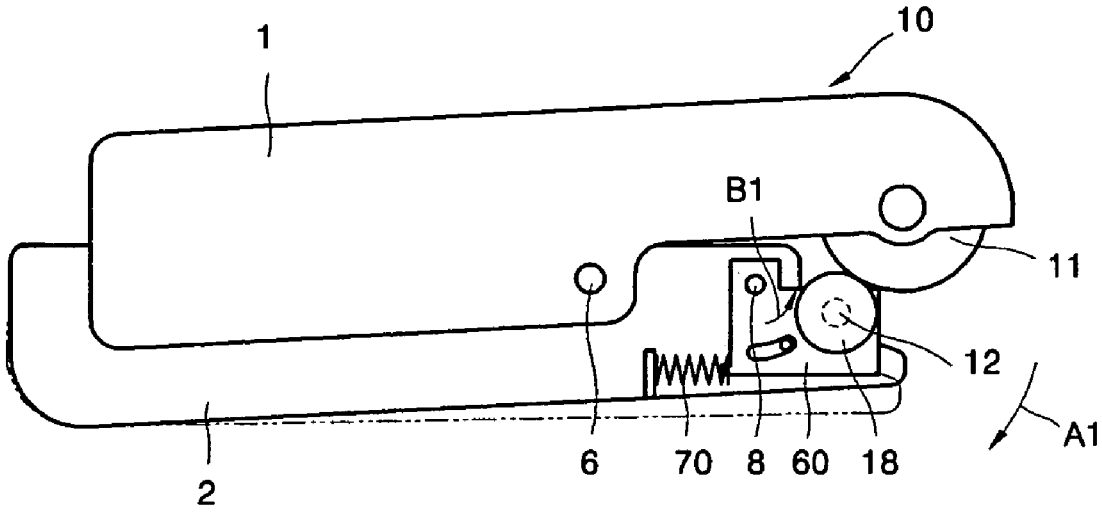
FIGS. 4 and 5 are views illustrating an operating effect of the developing cartridge illustrated in FIGS. 2 and 3.

The operation effects of the above-described structure will be described with reference to FIGS. 4 and 5. As illustrated in FIG. 4, when the second frame 2 pivots in the A1 direction, where the developing roller 12 is distanced from the photosensitive drum 11 via the vibration produced in the printing process, the second springs 70 push the brackets 60 and pivot the brackets 60 in the opposite direction B1 to the A1 direction, which is the pivoting direction of the second frame 2 about the pivot pins 8. Therefore, the gap rings 18 maintain contact with the outer circumference of the photosensitive drum 11, and the developing gap is maintained.

Figure 5:
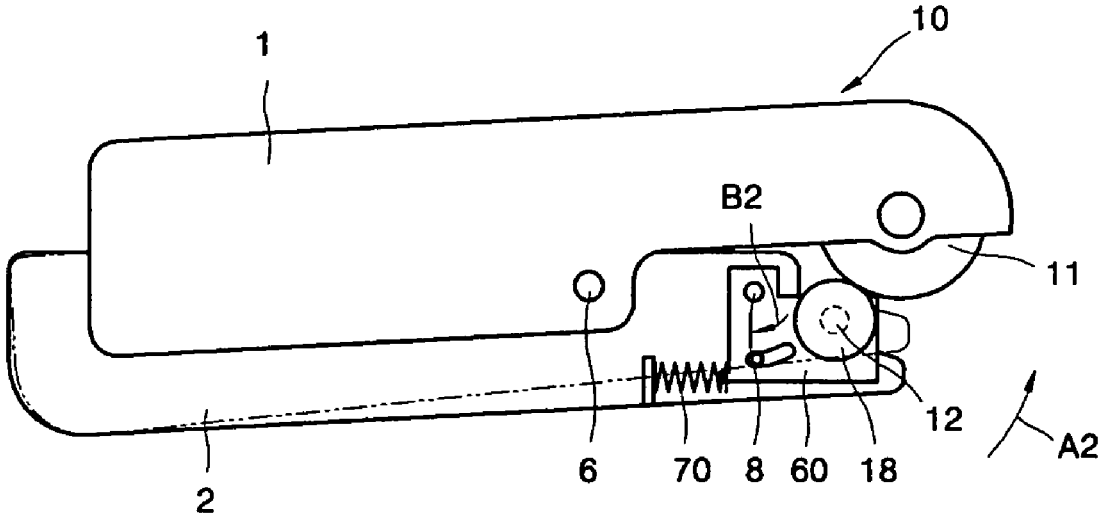

As illustrated in FIG. 5, the second frame 2 pivots in the A2 direction, where the developing roller 12 approaches the photosensitive drum 11, via the vibration produced in the printing process. Then, the photosensitive drum 11 pushes the gap rings 18. Thus, the brackets 60 pivot in the opposite direction B2 to the A2 direction, which is the pivoting direction of the second frame 2 about the pivot pins 8. Here, the second springs 70 are compressed and allow the brackets 60 to pivot in the B2 direction. Therefore, the gap rings 18 maintain contact with the outer circumference of the photosensitive drum 11, and the developing roller 12 and the developing gap is maintained.

As described above, even if the second frame 2 pivots in the A1 and A2 direction by vibrations caused during the printing process, the developing roller 12 and the gap rings 18 are pivoted in the opposite directions B1 and B2. As a result, the developing gap between the developing roller 12 and the photosensitive drum 11 is maintained. In addition, the gap rings 18 can continue to remain in contact with the photosensitive drum 11 as the gap rings 18 elastically move in the direction to maintain the developing gap in response to the pivoting of the second frame 2. Therefore, impact applied to the photosensitive drum 11 can be prevented by the gap rings 18.

It is also possible to make the center of pivot of the developing roller 12, the gap rings 18, and the second frame 2 the same. For example, the shape of the brackets 60 extend as illustrated by the dotted lines of FIG. 3, through-holes 62*a* are formed to be concentric with the through-holes 4 and 5, and the coupling pins 6 are inserted through three through-holes 4, 5, and 62*a*. As a result, even if the developing roller 12 and the gap rings 18 are pivoted by the pivoting of the second frame 2, the relative location of the developing roller 12 and the gap rings 18 with respect to the photosensitive drum 11, the supplying roller 16 and the limiting element 17, for example, does not change. Therefore, the quality of the image can be uniformly maintained.

Figure 6:
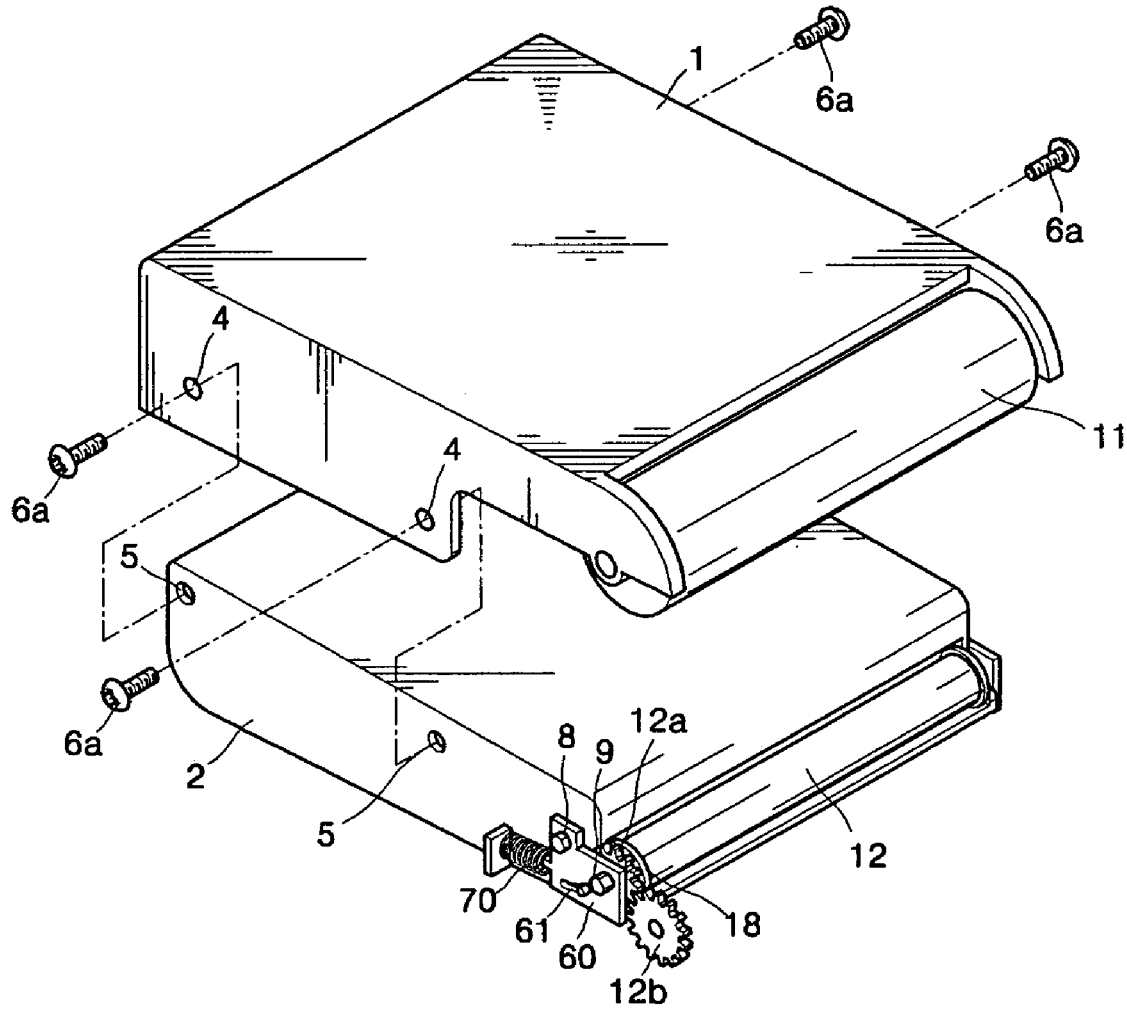
FIG. 6 is a perspective view of a developing cartridge according to another embodiment of the present invention.

As described above, the structure in which the developing roller 12 is elastically biased towards the photosensitive drum 11 can be applied in the structure in which the second frame 2 is pivotably coupled to the first frame 1, as well as in the structure in which first and second frames 1 and 2 are fixedly coupled illustrated in FIG. 6. Components in FIG. 6, that are previously described, have the same reference numerals as in the previous drawings, and thus their descriptions will be omitted for clarity and conciseness. Referring to FIG. 6, the first and second frames 1 and 2 are coupled, for example, by four fixing screws 6*a*. Generally, a gear 12*a* is coupled to only one end of a developing roller 12 in order to rotate the developing roller 12. The gear 12*a* is meshed with a driving gear 12*b*, which is rotated by a driving motor (not shown). In this case, a force is applied to the one end of the developing roller 12 to which the gear 12*a* is coupled in a direction away from the photosensitive drum 11. Alternatively, a force is applied to the one end of the developing roller 12 to which the gear 12*a* is coupled in a direction towards the photosensitive drum 11. The direction of force application depends on the rotation direction of the driving gear 12*b* meshed with the gear 12*a* and the location at which the gear 12*a* and the driving gear 12*b* meshes. A force opposite to the force applied to the one end is applied to the other end of the developing roller 12 at which the gear 12*a* is not coupled. Since the gap rings 18 are supported by the photosensitive drum 11, a distance between the photosensitive drum 11 and the developing roller 12 becomes smaller than the developing gap. This is due to the biasing force acting to move the developing roller 12 towards the photosensitive drum 11. However, due to the biasing force acting to move the developing roller 12 away from the photosensitive drum 11, the developing roller 12 separates from the photosensitive drum 11 and a distance between the developing roller 12 and the photosensitive drum 11 becomes larger than the developing gap. Thus, the developing gap becomes uneven along the length of the developing roller 12. Therefore, the developing gap can become uniform along the length of the developing roller 12 by elastically biasing the developing roller 12 towards the photosensitive drum 11 as illustrated in FIG. 6.

In the above-described exemplary embodiment, the color image forming apparatus includes preferably four developing cartridges. However, the present invention is not limited by the number of developing cartridges 10.

According to a developing cartridge and an electrophotographic image forming apparatus employing the same as described above, the quality of an image can be relatively improved via maintaining a constant developing gap during the printing process even during vibrations. In addition, impact from the vibrations applied to a photosensitive drum caused during the printing process can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus comprising:

a photosensitive drum, on which an electrostatic latent image is formed;

at least one developing cartridge including a developing roller which develops a toner image by supplying a developer to the electrostatic latent image; and a transfer unit which transfers the toner images onto a print medium, wherein the at least one developing cartridge comprises:

a first frame on which the photosensitive drum is arranged;

a second frame which is pivotably coupled to the first frame and coupled to the developing roller;

a first elastic element which provides an elastic force biasing the second frame in the direction towards the first frame; and gap maintaining elements which limit the pivoting of the second frame so that a developing gap is maintained, and the developing roller and the gap maintaining elements are arranged on the second frame to move in a direction opposite to a pivoting direction of the second frame.

2. The image forming apparatus of claim 1, the at least one developing cartridge further comprising brackets which are pivotably arranged on the second frame and support the developing roller and the gap maintaining elements; and second elastic elements which push the brackets towards the photosensitive drum.

3. The image forming apparatus of claim 2, wherein a center pivot of the brackets with respect to the second frame is about the same as a center of pivot of the second frame with respect to the first frame.

4. The image forming apparatus of claim 1, wherein the gap maintaining elements include a pair of gap rings which are rotatably arranged on both ends of the developing roller and in contact with the photosensitive drum.

5. The image forming apparatus of claim 1, the developer is stored in the second frame.

6. The image forming apparatus of claim 5, further comprising an exposure element which emits light onto the photosensitive drum to form the electrostatic latent image on the photosensitive drum, wherein the light is emitted to the photosensitive drum through a space formed between the first and second frames.

7. The image forming apparatus of claim 1, wherein the at least one developing cartridge comprises a plurality of developing cartridges, in which developers of different colors are stored in the second frame; and a plurality of exposure elements emit light onto the photosensitive drum of each of the plurality of developing cartridges, and the transfer unit comprises:

a paper transporting belt which is arranged to face the photosensitive drums of the plurality of developing cartridges, and supports and transports the medium; and a plurality of transfer rollers which are arranged to face the photosensitive drums with the paper transporting belt therebetween, and on which a transfer bias is applied to transfer the toner image formed on outer circumferences of the photosensitive drums to the medium.

8. The image forming apparatus of claim 7, wherein the light emitted from the plurality of exposure elements are emitted onto each of the photosensitive drums through spaces formed between the first and second frames in the plurality of developing cartridges.

9. An image forming apparatus comprising:

a photosensitive drum on which an electrostatic latent image is formed;

a developing cartridge including a developing roller that develops a toner image by supplying a developer to the electrostatic latent image; and a transfer unit which transfers the toner images onto a medium, wherein the developing cartridge includes:

a first frame on which the photosensitive drum is arranged;

a second frame on which the developing roller is arranged and coupled to the first frame; and a pair of gap maintaining elements rotatably coupled to both ends of the developing roller configured to contact the photosensitive drum so that a developing gap is maintained between the developing roller and the photosensitive drum, and the developing roller and the pair of gap maintaining elements are arranged on the second frame to elastically pivot in a direction towards the photosensitive drum.

10. The image forming apparatus of claim 9, wherein the developer is stored in the second frame.

11. The image forming apparatus of claim 10, further comprising an exposure element which forms the electrostatic latent image on an outer circumference of the photosensitive drum by emitting light onto the photosensitive drum, wherein the light is emitted onto the photosensitive drum through a space formed between the first and second frames.

12. The image forming apparatus of claim 9, wherein the developing cartridge comprises a plurality of developing cartridges in which developers of different colors are stored in the second frame; and a plurality of exposure elements emit light onto the photosensitive drum of each of the plurality of developing cartridges, and the transfer unit comprises:

a paper transporting belt which is arranged to face the photosensitive drums of the plurality of developing cartridges, and supports and transports the medium; and a plurality of transfer rollers which are arranged to face the photosensitive drums with the paper transporting belt therebetween, and on which a transfer bias is applied to transfer the toner image formed on outer circumferences of the photosensitive drums to the medium.

13. The image forming apparatus of claim 12, wherein the light emitted from the plurality of exposure elements are emitted onto each of the photosensitive drums through spaces formed between the first and second frames in the plurality of developing cartridges.

14. A developing cartridge, comprising:

a first frame in which a photosensitive drum is arranged;

a second frame in which a developing roller is arranged and coupled to the first frame so that the second frame elastically pivots in a direction in which the developing roller approaches or separates from the photosensitive drum; and a pair of gap maintaining elements which limit the pivoting of the second frame in a direction in which the developing roller approaches the photosensitive drum by being rotatably coupled to both ends of the developing roller and being in contact with the photosensitive drum so that the developing roller can be arranged at a location that maintains a developing gap with the photosensitive drum, wherein the developing roller and the pair of gap maintaining elements are arranged on the second frame to elastically pivot in an opposite direction to a pivoting direction of the second frame.

15. The developing cartridge of claim 14, wherein a center of pivot of the developing roller and the pair of gap maintaining elements with respect to the second frame and a center of pivot of the second frame with respect to the first frame are about the same.

16. An image forming apparatus comprising:

a photosensitive drum arranged on a first frame;

a developing roller arranged on a second frame, which is coupled to the first frame; and a pair of gap maintaining elements, rotatably coupled to both ends of the developing roller, and which contact the photosensitive drum so that the developing roller can be arranged at a location to maintain a developing gap with the photosensitive drum, wherein the developing roller and the pair of gap maintaining elements are arranged on the second frame to elastically pivot in a direction in which the gap maintaining elements contact the photosensitive drum.

* * * * *